United States Patent [19]

Lopata et al.

[11] 4,287,017

[45] Sep. 1, 1981

[54] ENDLESS PRESSING-ON AND GUIDING BELT FOR TEXTILE TREATING DEVICES, ESPECIALLY TRANSFER PRINTING MACHINES AND STEAMING CALENDERS

[75] Inventors: Karl-Peter Lopata, Krefeld; Wolfgang Tschirner, Tönisvorst, both of Fed. Rep. of Germany

[73] Assignee: Kleinewefers GmbH, Krefeld, Fed. Rep. of Germany

[21] Appl. No.: 91,501

[22] Filed: Nov. 5, 1979

Related U.S. Application Data

[63] Continuation of Ser. No. 908,272, May 22, 1978, abandoned.

[30] Foreign Application Priority Data

May 21, 1977 [DE] Fed. Rep. of Germany ..... 2723085

[51] Int. Cl.[3] ..... B30B 5/04; B30B 15/34

[52] U.S. Cl. ..... 156/583.5; 8/467; 139/425 A; 101/470; 245/10; 428/193

[58] Field of Search ..... 101/470; 8/2.5 A; 139/425 A; 245/10; 428/193; 156/583.5

[56] References Cited

U.S. PATENT DOCUMENTS

| | | | |
|---|---|---|---|
| 361,002 | 4/1887 | Devore | 245/10 |
| 2,066,369 | 1/1937 | Specht | 139/425 A |
| 2,082,513 | 6/1937 | Roberts | 139/425 A |
| 2,269,869 | 1/1942 | Specht | 139/425 A |
| 3,216,893 | 11/1965 | Schuster | 139/425 A |
| 3,306,322 | 2/1967 | Willmann | 139/425 A |
| 3,523,867 | 8/1970 | MacBean | 139/425 A |
| 3,597,300 | 8/1971 | Miller | 428/193 |
| 4,056,352 | 11/1977 | Mayer | 101/470 |
| 4,116,022 | 9/1978 | Lopata et al. | 101/470 |

FOREIGN PATENT DOCUMENTS

| | | | |
|---|---|---|---|
| 708758 | 5/1965 | Canada | 139/425 A |

OTHER PUBLICATIONS

Handbook of Chemistry, Lange, Handbook Publishers, 1934, pp. 552 and 553.

*Primary Examiner*—Clyde I. Goughenour
*Attorney, Agent, or Firm*—Becker & Becker, Inc.

[57] ABSTRACT

An endless pressing-on and guiding belt including a belt piece having its end faces joined together, for textile treating devices, especially transfer printing machines and steaming calenders, with a rotary drum having a longitudinal section of the endless belt partially looped therearound while textile material to be treated is interposed between the drum and the belt, the latter being heated on the drum. The endless belt includes a fabric with a bronze-solid wire warp and a weft of a metallic nickel-alloy solid wire with the bronze solid wire warp extending in the longitudinal direction of the belt.

10 Claims, 6 Drawing Figures

ENDLESS PRESSING-ON AND GUIDING BELT FOR TEXTILE TREATING DEVICES, ESPECIALLY TRANSFER PRINTING MACHINES AND STEAMING CALENDERS

This is a continuation of application Ser. No. 908,272-Lopata et al. filed May 22, 1978, now abandoned.

The present invention relates to an endless pressing-on and guiding belt for textile treating devices as for instance transfer printing machines or a steaming calender. The belt is made of a belt section having its end faces connected to each other. More specifically, the invention relates to an endless belt as set forth with a rotary drum. Partially looped around a surface of the drum is a longitudinal section of said endless belt with a layer of textile material interposed therebetween; the endless belt is heated on this layer. The heating can be effected by a heating device in the interior of the drum, by radiation, or by subjecting said layer to a hot air current.

With heretofore known textile treating devices of the above mentioned type, especially with transfer printing machines, temperature resistant endless felt belts or blankets are utilized pressing against the drum surface occurs by means of a section of belt or blanket length surrounding the textile material and at a pressure correponding to the tension of the belt as disclosed for instance in German Offenlegungsschrift No. 24 38 262. These known felt belts or blankets, however, have a relatively short lifespan and a relatively low pull resistance so that the pressure at which the textile material is pressed against the drum is limited. When the belt is under a relatively low tension, the felt belts exert an uneven specific surface pressure which during a transfer printing operation brings about for instance a cloudiness of the color reproduction. Furthermore, the heretofore known endless felt belts are easily soiled and permit only a poor possibility for cleaning purposes. In addition to encountering a slight transverse current, which means a low permeability is encountered, the felt belt frequently develops or encounters a local heat accumulation.

French Pat. No. 7301505 discloses a device for the transfer printing process, according to which the textile material by means of an air permeable paper strip carrying the subliming dyestuff is passed over a porous and heat conductive plane grate. The heat from that side which faces away from the grate is conveyed to the textile material and the paper strip carrying the dyestuff, and an air or gas stream or current is passed through both said textile material and said paper strip.

It is an object of the present invention to provide an endless belt of the above mentioned type which compared with known belts of the type involved will be thinner and will with the same pull resistance and a better air permeability as well as a longer lifespan have a better form stability, due to the higher wear resistance, especially while being subjected to heat; also the belt will have a lower inner tension by means of which also the entire belt tension can be lowered without having to fear cloud formation.

It is another object of this invention to provide an endless belt as set forth in the preceding paragraph which is less susceptible to be soiled and permits an easy cleaning of the belt.

It is still a further object of this invention to provide a belt as set forth above, which has less filtering behavior, reduces or prevents the buildup of residues or prevents the buildup of residues in the belt, has the ability faster to absorb and give off heat, and has a high temperature resistance.

In textile treating containers, it is possible to employ belts of temperature-resistant synthetic fibers. However, such belts can only be cut from a hose or have to be netted to form a hose whereby their use in such textile treating devices is impossible in which the rotary drum and/or deviating or reversing rollers are not freely accessible from the side so as to permit the endless belt to be placed from the side upon the rotary drum and the deviating or reversing rollers. This is the case for instance with transfer printing machines in which the rotary drum is surrounded by a suction or vacuum chamber.

It is, therefore, still another object of the invention to provide an endless belt of the type set forth in the preceding paragraphs which will be usable with rotary drums and/or deviating or reversing rollers which are freely accessible from the side and are also non-accessible from the side. In other words, it is a further object of the present invention to provide an endless belt from a belt section both end faces of which are connected along a seam without causing marks on the textile material to be treated. The belt section can, therefore, first be looped in its longitudinal direction about the rotary drum and the deviating rollers and subsequently the end faces can be interconnected.

For the sake of completeness, it may be mentioned that a woven and differently finished endless belt of a high grade steel has the advantage of being able to resist high mechanical stresses, and has a long lifespan as well as a good form stability, but such an endless belt of high grade steel-belt section can not be provided with such a fine seam that it will not leave any marks in the form of transverse lines on the treated textile material.

These and other objects and advantages of the invention will appear more clearly from the following specification in connection with the following drawings, in which.

Figure 1:
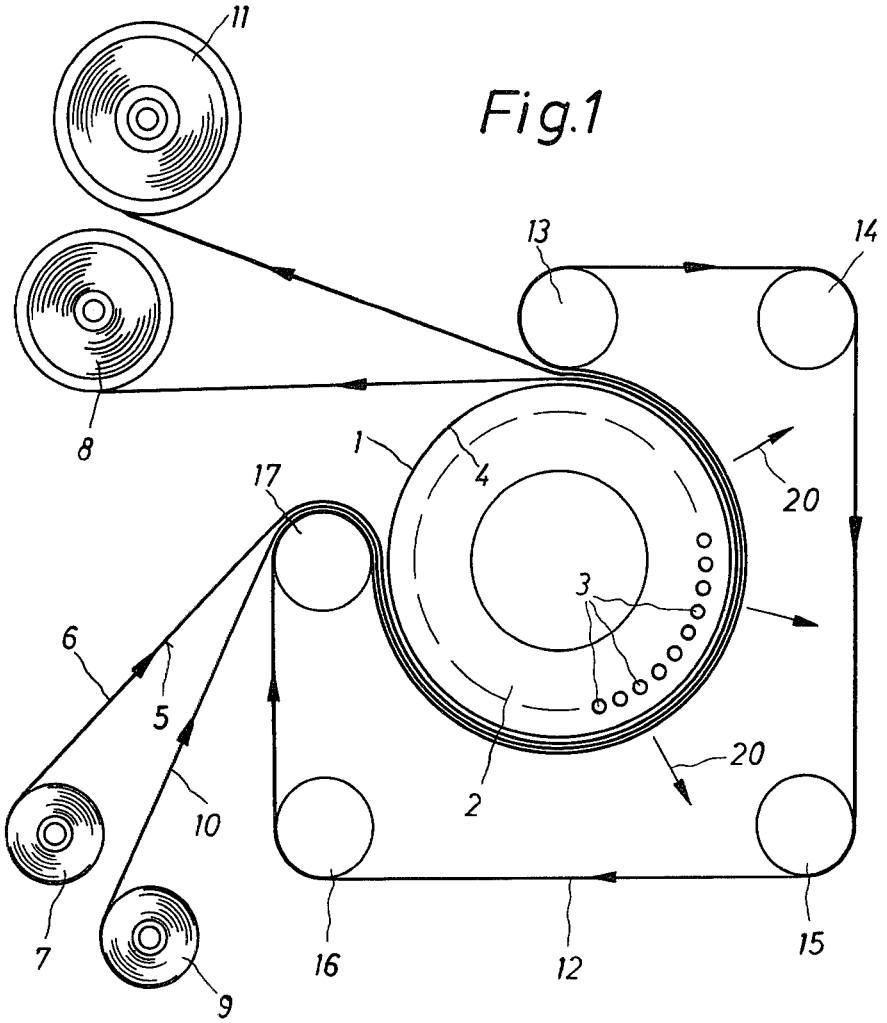
FIG. 1 illustrates an arrangement of a belt according to the invention in a transfer printing device.
Figure 2:
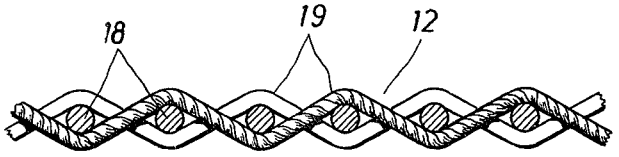
FIG. 2 is a fragmentary section through the belt transverse to a weft or a weft strand.

The endless belt according to the invention is characterized primarily in that it consists of a fabric with a bronze solid wire chain and a weft of a metallic solid wire or of a temperature resistant synthetic thread or a temperature-resistant synthetic or metallic strand while the bronze-solid wire chain extends in the longitudinal direction of the belt.

The bronze-solid wires of the chain permit a very fine transverse welding seam of the belt which avoids markings in the form of transverse lines or other lines on the textile material, but otherwise have a sufficient pull-resistance, form stability and low inner tension, as well as a sufficient wear-resistance for a longer lifespan. The weft which preferably is used in the form of bronze or nickel strand meets the above mentioned requirement for a belt of the type involved and, in particular, the strand character of the weft contributes to the form stability of the weft in a transverse direction of the belt to a particular extent so that waves are avoided which extend parallel to each other in the longitudinal direction to the belt. Such waves cause regions of lower belt tension adjacent regions of higher belt tensions whereby a stripe and cloud formation on the textile material is created. According to a further development of the invention, the total thickness of the fabric amounts to 2 mm or less. When employing a synthetic thread or a strand of synthetic material, these threads or strands can be roughened or slightly matted. The metal strands used as weft preferably have a linear expansion coefficient of approximately $0.90\times10^6$ and 36% nickel-steel corresponds extensively with these requirements.

The weaving type of the belt, depending on the requirements to be met by the belt, will lend or give the belt a more or less high air and gas permeability.

According to a further development of the invention, those weft thread ends which have a cutting or shearing edge and project beyond the outer warp ends, are provided with a smooth walled cover or a smooth walled reinforcement. The smooth walled reinforcement of the weft ends can be realized in various manners, for instance by a pear or ball shaped upsetting of the ends. This may be effected by a cold preferably however, heat deformable method with metallic weft threads as well as with weft threads of synthetic material.

Another possibility of designing the smooth walled cover consists in that the smooth walled cover of the metallic weft thread ends is formed by a solder pearl.

When the weft threads of the pressing-on and guiding belt consists of a metallic strand, the smooth walled cover of the weft thread end can be formed by soldering the wires of the strand to each other so that a cylindrical or pear-shaped smooth wall reinforcement of soldering material is formed for the metal strand.

A still further possibility of forming a smooth walled cover on the weft thread ends consists in that a continuous protective belt is placed over said weft thread ends at least on one side. This protective belt is soldered or cemented to the weft thread ends of each belt side. In this connection, the protective belt, which is preferably elastic, surrounds the weft thread ends in a U-shaped manner so that the sharp edged ends of the weft threads are on all sides surrounded by the continuous protective belt.

Preferably, the cover or reinforcement has a thickness which corresponds to the thickness of the belt or at least approximately corresponds to said thickness.

According to still another embodiment of the design of the belt according to the invention, the metallic or synthetic threads which have a round cross section are ground flat at their top and bottom side, for instance are ground off so that thread sections are formed on both sides of the belt plane, and the intermediate belt plane will touch the textile web much closer and thus come closer to the dye carrier during the transfer printing operation.

Referring now to the drawings in detail, the transfer printing device diagrammatically illustrated in FIG. 1 comprises a rotary drum 1 adapted to rotate in counterclockwise direction. In the inner chamber 2 of said drum 1 there are heating rods 3 arranged along a circle coaxially with said drum 1 and in the vicinity of the mantle 4 so that the mantle 4 will be heated substantially uniformly. The drum 1 has over an angle of 270° directly looped thereon a paper strip 6 which carries the sublimable dyestuff on its outside 5. The paper strip 6 is withdrawn from a reel 7 and, depending on the dispensing of the dyestuff to the textile material on the drum, the paper strip 6 is wound on a reel 8. The textile web 10 to be printed upon is withdrawn from a supply reel 9 and while resting on the paper strip 6, the web 10 is likewise looped around the drum, and after being printed upon is wound again onto the reel 11, on another treating device on the reel 11, or is conveyed to another processing device.

The quality of the transfer print is among others dependent on how the web of textile material 10 is pressed against the paper strip 6 while being looped around drum 1. This pressing is carried out by the endless belt 12 which from the outside at the level of drum 1 engages the web 10 of textile material. The endless belt 12 passes over the deviating rollers 13–16 and the roller 17 common to the paper strip 6, the web 10 of textile material and the endless belt 12. The belt is subjected to the heat emanated by the heating rods 3 and, inasmuch as one or more of the rollers 13–16 are adjustable correspondingly the belt is subjected to an adjustable pull in longitudinal direction whereby the pressing-on force of the belt 12 against the textile web 10 and thus the textile web 10 is adjustable relative to the paper strip 6. In the illustrated embodiment, the endless belt comprises a fabric of bronze-solid wires forming the warp threads 19, and of weft threads 18 which consist of temperature-resistant synthetic threads, or better, even of a metallic strand. The ends of the bronze-solid wire warp threads which extend in the longitudinal direction of the belt, which means in circumferential direction of the belt, can be connected to each other without forming a considerable soldering area which causes a marking on the textile web. In this connection, it may be stated that also such metallic solid wires which have the same or similar values when being subjected to heat and pull and permit a seamless or nearly seamless connection of their ends are within the scope of the present invention.

The weft threads are preferably bronze or nickel strands. Also strands of different alloys can be utilized if they have the properties of the above mentioned strands.

Depending on the weaving type, the belt 12 assures the desired air and gas permeability in order for instance from the outside of the belt section surrounding the drum 1 in the direction of arrow 20 to exert a suction pull upon the sublimed dyestuff gas in order to permit a faster and deeper penetration thereof into the textile web.

The ends of the weft threads 18 of synthetic material or metal which project beyond the lateral warp threads, have a sharp cutting or shearing edge by means of which the deviating rollers 13–16 and as the case may be the surface of drum 1, especially, however, the webs 6 and 10 may be damaged. The belt edges act similar to sawteeth upon the rollers and webs. If the drum 1 is centrically surrounded by a pressure chamber, the band edges damage the seals between the drum and the chamber walls.

Figure 3:
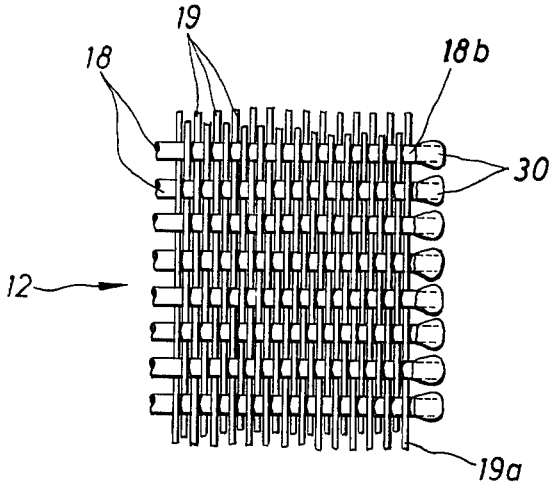
FIG. 3 represents a section of a rim of a belt according to the invention with a rim reinforcement.
Figure 4:
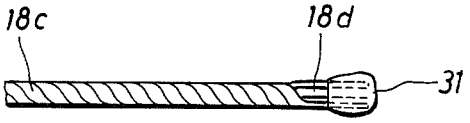
FIG. 4 shows the end of a weft formed from a metal strand composed of a plurality of wires.

In order to avoid such damage, the ends **18*b* of the weft threads 18 according to the embodiment of FIG. 3 are provided with a coat 30 of solder by means of which a smooth walled pear-shaped reinforcement of the weft thread ends 18*b* will be obtained projecting beyond the lateral warp threads 19*a*. According to the embodiment of FIG. 4, a metal strand is utilized as weft thread. The wires of said metal strand are connected to each other and thereby form a pear-shaped solder cap 31**.

Figure 5:
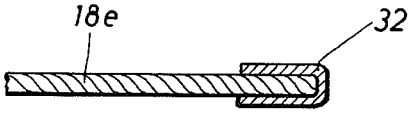
FIG. 5 shows an embodiment with a continuous band in a U-shaped manner embracing the ends of the weft.

According to the embodiment of FIG. 5, the end of the weft threads are covered by a continuous belt 32 which is U-shaped in cross section. The belt 32 is soldered either onto the metallic weft threads 18*e* or is cemented to the weft thread of synthetic material. The belt 32 is flexible and can adapt itself to the curvature of the belt 12.

The reinforcements and the thicknesses have a thickness corresponding to the thickness of the entire unit which means corresponding to the thickness of the weft thread to which is added twice the thickness of the thin warp threads 19.

Figure 6:
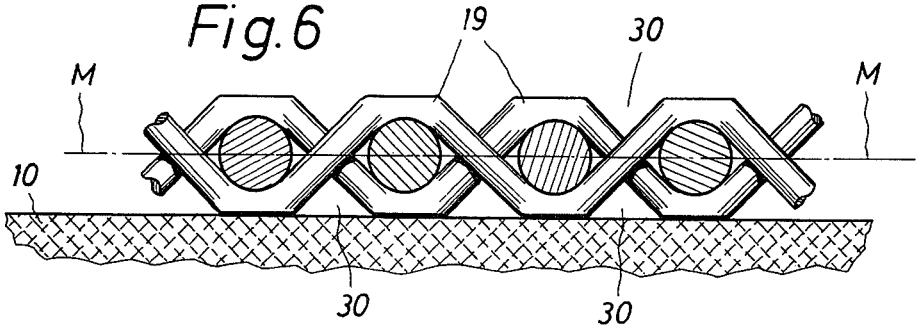
FIG. 6 is a cross section through a pressing-on belt with which the threads on the belt surface and bottom side are flattened.

According to the embodiment of FIG. 6, the warp threads 19 are flattened on both sides of the belt so that the central plane M of the belt comes closer to the textile path 10, and the intermediate spaces 30 between the threads 19 become smaller.

It is, of course, to be understood that the present invention is, by no means, limited to the specific showing in the drawings, but also comprises any modifications within the scope of the appended claims.

What we claim is:

1. In a transfer printing machine which comprises a rotary drum, means for heating said drum and two webs passing together about said drum, the first web of fabric to be printed and the second web carrying material for printing on said first web, and means for heating said drum, an endless belt passing about said two webs and drum and pressing said webs against said drum as said drum rotates, said endless belt being formed of a woven fabric having a warp consisting exclusively of solid bronze threads extending longitudinally of said belt and a weft consisting exclusively of solid metal wires of nickel-alloy.

2. The machine according to claim 1, in which the metal strands serving as wefts have a linear expansion coefficient of about $0.90 \times 10^6$.

3. The machine according to claim 1, in which ends of wefts laterally project beyond the outermost warps and have a cutting or shearing edge and are provided with a smooth-walled cover.

4. The machine according to claim 1, in which ends of wefts laterally project beyond the outermost warps and have a cutting or shearing edge and are provided with smooth-walled reinforcing means.

5. The machine according to claim 4, in which said smooth-walled reinforcing means have a pear-or ball-shaped configuration.

6. The machine according to claim 3, in which said wefts consist of metallic strands, and in which said smooth-walled cover is formed by a soldering of the strand wires.

7. The machine according to claim 3, which includes a continuous protective band placed at least unilaterally over the ends of said wefts, said protective band being connected to the weft ends of one belt side.

8. The machine according to claim 7, in which said protective band is elastic and embraces said thread ends in a U-shaped manner.

9. The machine according to claim 4, in which said reinforcing means has a thickness corresponding to at least approximately the thickness of said belt.

10. The machine according to claim 1, in which said warps are cross-sectionally round wires flattened at least on one side of said belt.

* * * * *